United States Patent [19]

Grubis

[11] 4,075,526

[45] Feb. 21, 1978

[54] HOT-CATHODE X-RAY TUBE HAVING AN END-MOUNTED ANODE

[75] Inventor: Bernard Grubis, Paris, France

[73] Assignee: Compagnie Generale de Radiologie, Paris, France

[21] Appl. No.: 739,178

[22] Filed: Nov. 5, 1976

[30] Foreign Application Priority Data

Nov. 28, 1975 France ..... 75 36607

[51] Int. Cl.[2] ..... H01J 35/14

[52] U.S. Cl. ..... 313/56; 313/57

[58] Field of Search ..... 313/57, 56

[56] References Cited

U.S. PATENT DOCUMENTS 3,892,989 7/1975 Gralenski et al. ..... 313/57 X

*Primary Examiner*—Rudolph V. Rolinec

*Assistant Examiner*—Darwin R. Hostetter

*Attorney, Agent, or Firm*—Edwin E. Greigg

[57] ABSTRACT

A hot-cathode X-ray tube having an end-mounted anode and a low energy consumption, including a filament, an anode in the form of a plate orientated perpendicularly to the electron beam which is emitted by the filament, an annular auxiliary electrode having a central opening and forming a diaphragm for the electron beam and a secondary anode for back scattered electrons. The anode and the diaphragm are made from the same metal selected from silver, rhodium, copper and molybdenum and at least the portions of the secondary anode facing the primary one are coated with the same metal.

The tube may be used as a source of quasi-monochromatic radiation in apparatus for spectrometry by X-ray fluorescence, diffractometry and microradiography.

18 Claims, 1 Drawing Figure

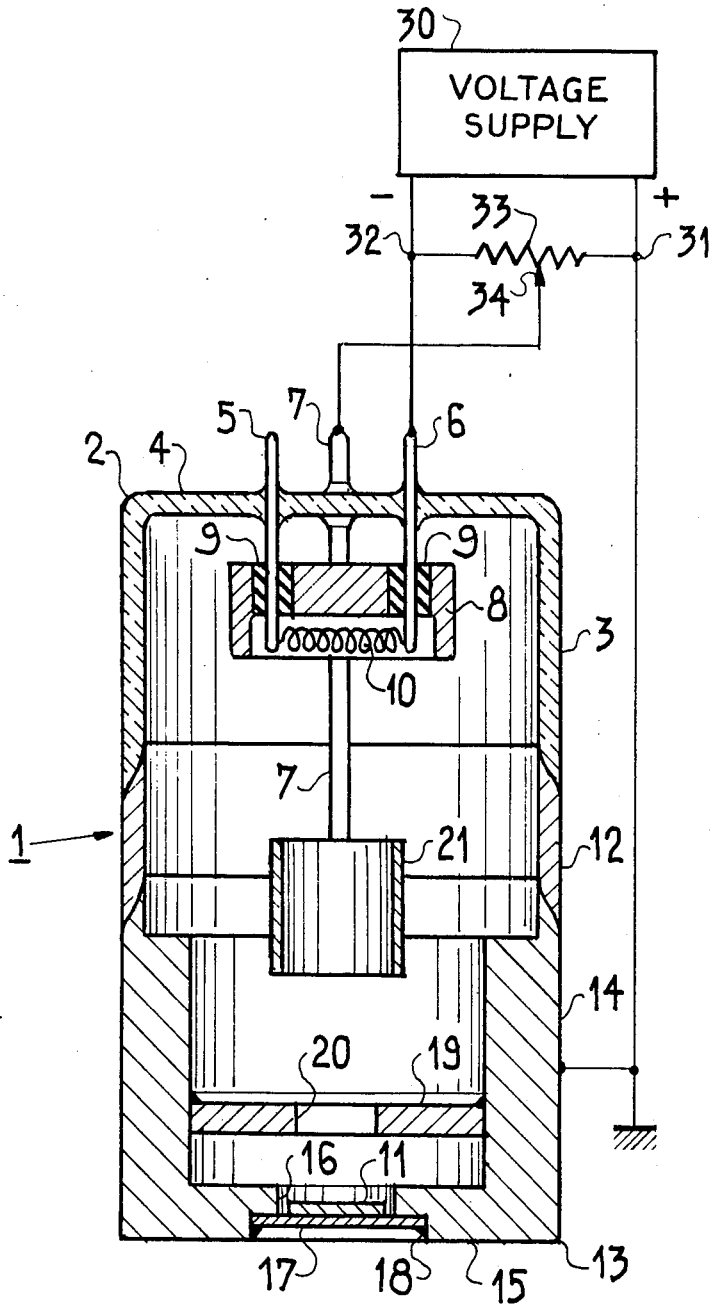
30
VOLTAGE SUPPLY
−
+
32
33
31
34
5
7
6
2
4
9
9
8
3
10
7
1
21
12
14
20
19
16
11
17
18
15
13

HOT-CATHODE X-RAY TUBE HAVING AN END-MOUNTED ANODE

BACKGROUND OF THE INVENTION

The present invention relates to a low-consumption hot-cathode X-ray tube which can be used as a source of quasimonochromatic radiation, in particular for apparatus for spectrometry, diffractometry and microradiography.

In an article of a Dutch review "NUCLEAR INSTRUMENTS AND METHODS", Vol. 78, n° 2, of Feb. 15, 1970, pages 305 to 313, there were described hot and cold-cathode X-ray tubes which have a combined target-window in the form of a plate located at the end of the tube, allowing the emission of virtually monochromatic X-ray radiation due to the fact that the anode at the same time forms a filter for the radiation which it produces, which filter enhances characteristic lines of the emitted spectrum.

The use of a cold cathode implies the stabilization of the anode current, which is a matter of some difficulty, by continuous pumped evacuation to provide a primary vacuum and by using a controllable bleed device controlled by the curreent to stabilize the residual gas pressure in the tube. The pumping unit and controllable bleed device used for this purpose have a weight and electrical energy consumption which are too high for them to be made easily transportable.

The present invention relates to an advantageous embodiment of a low energy consumption, hot-cathode X-ray tube having an end-mounted anode, which can be used in transportable X-ray apparatus such as soil spectrometers, which are intended in particular for analyzing relatively light elements (having an atomic number Z lower than 45) by means of X-ray fluorescence, by exciting their K spectra. Heavier elements may also be analyzing analysed by using their L spectra.

According to the invention, there is provided a hot-cathode X-ray tube having a metal anode in the form of a plate located at its end, perpendicularly to the axis of the electron beam, which beam bombards the anode in such a way that at least part of the useful beam of X-rays produced by this bombardment passes through the thickness of the anode, which filters the beam by allowing to pass the characteristic radiation of the material forming the anode, further comprising: a first additional electrode of annular shape provided with a central opening and which is arranged in the path of the electron beam near the anode and parallel thereto, the said first additional electrode being at the same potential as the anode and having at least its surface made of the same metal as the said anode, whereby the radiation therefrom is supplemented by radiation due to electrons back-scattered as a result of elastic collision with the anode and which strike the first additional electrode.

The invention will be better understood and others of its features and advantages will become apparent from the following description and from the single accompanying FIGURE relating thereto, given by way of example.

BRIEF DESCRIPTION OF THE DRAWING

The single FIGURE is a schematic elevational, axial, cross-sectional view of a preferred embodiment of an X-ray tube according to the invention.

DESCRIPTION OF THE PREFERRED EMBODIMENT

In the FIGURE, there is shown at 2 the glass (or ceramic) portion of the vacuum-tight envelope of the X-ray tube 1. This portion 2 includes a cylindrical sleeve portion 3 and a flat end wall 4 substantially perpendicular to the sleeve portion 3, the latter forming part of the sidewall of the envelope. The end wall 4 contains, vacuum-tightly sealed into it, metallic conductive lead-through connectors 5, 6 and 7, which also provide support for the electrodes located inside the envelope and allow bias potentials and supply currents to be fed to them from an external supply source 30. The first two lead-throughs 5 and 6 carry, fitted onto them, a concentrating member 8 made of a conductive material which is insulated from at least one of the lead-throughs by means of cylindrical sleeve 9 made of an insulating material. The two ends of these lead-throughs inside the envelope are attached to respective ends of a helical filament 10 made of a material which emits electrons when it is heated by an electrical current, such a material being, e.g. tungsten (W).

The concentrating member 8 contains a recess which surrounds approximately that half of the filament 10 adjacent to the end wall 4 of the envelope and, when it is brought to the same potential as the cathode, which is formed by filament 10, or to a more negative potential, the concentrating member has the effect of directing the electrons emitted by the cathode away from it, and of concentrating them into a beam directed toward the anode 11.

The opposite end of the sleeve 3 of the insulating portion 2 (glass or ceramic) of the envelope is sealed to one of the ends of an intermediate part 12 in the shape of a hollow cylinder, which is made of a metal alloy having a coefficient of thermal expansion close to that of glass or the ceramic, such as the alloy made up of iron (more than 50%) nickel (between 28 and 29%) and cobalt (between 17 and 18%) which is marketed under the name "Kovar", "Invar", "Fernico" or "Dilver P" (registered trademarks).

The other end of this intermediate metallic part is brazed to a further metallic part 13 which supports the anode 11 and which comprises a hollow cylindrical portion 14 and a flat end wall 15 perpendicular to the cylindrical portion. The anode-supporting part 13 is machined, for example, from solid copper, and in the center of the flat end wall 15, it has a circular opening 16 which is closed by a thin round plate 17 of a material which is relatively transparent to X-rays, such as beryllium (Be). This round plate 17 forms a window for the passage of X-ray radiation and is attached to the periphery of opening 16, for example, by means of a brazed joint 18, so as to form a vacuum-tight seal.

The anode 11 which, when bombarded by electrons emitted by cathode 10 produces X-rays, may be formed for example by a thin layer of metal which is plated or deposited on the inside face of window 17. In one embodiment of the tube 1 according to the invention, the plate 17 of beryllium is approximately 100 to 150 microns thick and its inside face is plated with a layer 11 a few microns thick of silver (Ag) or rhodium (Rh), the thickness of this layer 11 being for example between 2 and 4 microns.

In another embodiment, the window 17 and the anode 11 are formed by a single thin sheet of molybdenum (Mo) or pure copper (Cu) with a thickness of a few tens of microns. It is also possible to obtain characteristic radiation of silver or copper by making the window 17, which will also form the anode 11, from an alloy of beryllium and silver or copper (beryllium copper), with a high beryllium content and with thicknesses from several tens of microns to more than 100 microns. For the alloy of beryllium and silver, it is for example possible to use 3 to 8% of silver, and preferably approximately 5%, which makes it possible to obtain characteristic radiations of silver ($K_\alpha$, $K_\beta$, and $L_\alpha L_{L\beta}$) with intensities sufficient to excite fluorescent radiation in elements having atomic numbers lower than 45.

In accordance with the invention, the X-ray generating tube 1 also comprises, near the anode 11 or the combined target-window 17, a metal disc 19 which includes a central opening 20 letting the electron beam pass therethrough and which forms a diaphragm for the latter. This diaphragm 19 is arranged perpendicularly to the axis of the beam and is connected mechanically and electrically to the inside wall of the cylindrical metallic portion 14 of the anode-supporting part 13. This diaphragm disc 19 is made of the same metal as the anode 11 which is used to generate the X-ray radiation, since, when this is the case, the disc can be used to increase the efficiency of the tube, because the secondary electrons which are back-scattered as a result of elastic collisions with the atoms of the anode 11 strike the diaphragm with energies comparable to those of the primary electrons in the beam emitted by the cathode and which also generate supplemental X-rays in the diaphragm, part of which pass through the anode 11 (or the combined window and anode) and increase the total amount of radiation emitted by the tube.

As in all X-ray generating tubes having an end mounted anode 11, where the useful radiation has to pass through the anode 11 itself, the X-ray radiation emitted is filtered by the anode 11 and because of this, the K and L series of characteristic lines are enhanced in comparison with the white radiation which is attenuated to a greater degree as a result of this passage. These tubes are thus emitting a so-called quasimonochromatic radiation. The same also applies to the radiation generated by the secondary electrons which are back-scattered onto the diaphragm 19, the useable proportion of which also passes through the anode 11 and undergoes filtering there.

It is also possible to use a diaphragm 19 which is made of another metal, such as copper, and which is entirely covered with a layer of the same metal as that which forms the anode 11. The thickness of this layer covering the disc 19 may be appreciably greater than the thickness of anode 11, that is to say it may be several tens or several hundreds of microns.

It is also advantageous, with a view to eliminating possible undesirable radiation produced by electrons which are back-scattered onto the metal parts or strike them directly, to cover those portions of the inside wall of the anode-supporting part 13, and possibly of the focussing electrode 21, which are liable to be bombarded by these electrons, with a layer of the same metal as that forming anode 11 (whose K and/or L lines form the useful radiation).

In X-ray spectrometry, it is useful to have available the two K and L series of spectrum lines since the K lines produce good X-ray fluorescence in elements whose atomic number is slightly lower than that of the material of the anode and the L lines do the same with even lighter elements. Thus, the K lines of the spectrum of silver (Ag), whose atomic number is 47, can be used to excite fluorescence in elements ranging from rhodium (Rh) whose atomic number is 45, to potassium (K) whose atomic number is 19, and its L lines to excite fluorescence in elements ranging from chlorine (Cl) whose atomic number is 17, to boron (B) whose atomic number is 5. Similar results can be obtained with anodes made of rhodium (Rh), copper (Cu), and molybdenum (Mo).

It should be pointed out here that it is advantageous to make the beryllium windows 17 used as thin as possible, since they cause considerable attenuation to radiation of relatively long wavelengths, such as that of the L lines.

In addition, X-ray tubes with end-mounted anodes allow placing the samples to be irradiated close to the anode and by this means to increase the density of the primary beam which strikes the sample. In this way, an increase of the energy efficiency is obtained, from one to ten in comparison with conventional tubes, that is to say that a tube with an end-mounted anode produces at the sample, with a consumption of 200 to 250 watts, the same intensity of fluorescent radiation as a conventional tube with a consumption of approximately 2500 watts. The configuration with an end-mounted anode makes it easy to produce a multichannel spectrometer in which a plurality of collimators for the secondary (fluorescent) radiation is arranged in a star formation around the sample (not shown).

It is also advantageous to arrange, between the cathode 10 and the diaphragm 19 and along the path of the electron beam, a metallic focussing electrode 21 which is of cylindrical shape and which is carried by the metallic lead-through 7. This lead-through 7 also allows the application of an adjustable biassing potential to the focussing electrode 21 so as vary the size of the focus, that is to say the area of the anode 11 struck by the primary electrons.

Thus, the tube according to the invention may be used to analyze small samples or small areas with an irradiation density considerably higher than that obtained with conventional tubes in which it is necessary to reduce the cross-section of the primary X-ray beam between the tube and the sample by means of a diaphragm, thus producing a very poor photon density per unit area.

The focussing electrode 21 is preferably arranged nearer to the diaphragm 19 than to the cathode 10.

The anode 11 and the anode-supporting metallic part 13 are connected to ground and to the positive terminal 31 of a stabilized high voltage supply 30, whose negative terminal 32 is connected to one of the terminals (lead-through 6) of the cathode 10. This high voltage source 30 can supply a voltage which is adjustable between 10 and 40 kilovolts. Across the terminals 31 and 32 of the sorce 30 is connected a potentiometer 33 whose moving contact (wiper) 34 is connected to the lead-through 7 of the focussing electrode 21, so that the biassing voltage of the latter may be varied to enable the size of the focal point, that is to say the area of the anode 11 which is bombarded by the electron beam from the cathode 10, focussed by means of electrode 21, to be adjusted.

The current intensity of this beam is adjustable between 0 and 5 mA for example, by known means (not shown) such as a rheostat or an adjustable autotransformer which enables the heating current for the filament 10 to be varied, the filament is being fed with alternating current through an insulating transformer.

In one embodiment, the dimensions of the X-ray generating tube are as follows:

inside diameter of the metal anode-supporting part = 20 mm;
anode-diameter gap = 5 mm;
diameter of diaphragm opening = 6 mm;
diameter of anode = 6 to 8 mm;
length of focussing electrode = 10 mm;
cathode-focussing electrode gap = 25 to 35 mm.

The X-ray tube according to the invention forms a source of quasi-monochromatic radiation which has a low power consumption and which can be used for example in apparatus for analyzing soil by spectrometry or diffractometry.

What is claimed is:

1. An X-ray tube of the type having a hot cathode at one end, a main anode in the form of a metal plate perpendicular to the axis of the electron beam located at the other end thereof, said beam bombarding the main anode so that at least part of the useful X-ray beam generated by this bombardment passes through the thickness of the main anode, which acts as a filter for the emitted X-ray beam by allowing the characteristic radiation of the material forming the main anode to pass therethrough preferentially, further comprising: an annular secondary anode provided with a central opening arranged in the path of the electron beam, near the main anode and coaxial thereto, said secondary anode being at the same electrical potential as the main anode and having at least its surface made of the same metal as the main anode, thereby adding to the characteristic radiation from the main anode, a supplementary characteristic radiation resulting from electrons which are back-scattered due to elastic collisions with the atoms of the main anode and which strike the secondary anode.

2. X-ray tube as defined in claim 1, further comprising a focussing electrode in the shape of a hollow cylinder arranged between the cathode and the secondary anode, around the path of the electrion beam, said focussing electrode being biased by an adjustable voltage so as to vary the size of the area of the main anode which is bombarded by the said electron beam.

3. X-ray tube as defined in claim 1, wherein the main anode is formed by a layer of metal a few microns thick covering a window in the shape of a thin plate made of a metal transparent to X-rays such as beryllium which seals the tube off.

4. X-ray tube as defined in claim 3, wherein the metal forming the main anode (11) is selected from the class which consists of silver and rhodium.

5. X-ray tube as defined in claim 4, wherein the thickness of the metal layer forming the main anode is between 2 and 4 microns, and is preferably 3 microns, this layer being deposited on a window made of beryllium approximately 100 microns thick.

6. X-ray tube as defined in claim 1, wherein the main anode, which at the same time forms a sealing window, is a plate a few tens of microns thick made of a metal selected from the class consisting of copper and molybdenum.

7. X-ray tube as defined in claim 1, wherein the main anode, which at the same time forms a sealing window, is formed by a plate of an alloy of beryllium and of a metal which emits X-ray, the relative content of this latter metal being less than that of beryllium.

8. X-ray tube as defined in claim 7, wherein the X-ray emitting metal is selected from the group consisting of slver and copper.

9. X-ray tube as defined in claim 8, wherein the alloy of beryllium and silver has a silver content less than 8% and preferably 5%.

10. X-ray tube as defined in claim 1, of the type in which the vacuum-tight envelope has a metallic portion which supports said main anode and said secondary anode forming said diaphragm, wherein at least that portion of the inside face of the said metallic envelope portion which is liable to receive direct or back-scattered electrons is covered with a layer of a metal identical to that forming the main anode.

11. X-ray tube as defined in claim 2, wherein the main anode is formed by a layer of metal a few microns thick covering a window in the shape of a thin plate of a metal transparent to X-rays such as beryllium, which seals the tube off.

12. X-ray tube as defined in claim 11, wherein the metal forming the main anode is selected from the class which comprises silver and rhodium.

13. X-ray tube as defined in claim 12, wherein the thickness of the metal layer forming the main anode is between 2 and 4 microns, and is preferably 3 microns, this layer being deposited on a window made of beryllium approximately 100 microns thick.

14. X-ray tube as defined in claim 2, wherein the main anode, which at the same time forms a sealing window, is formed by a plate a few tens of microns thick of a metal selected from the class consisting of copper and molybdenum.

15. X-ray tube as defined in claim 2, wherein the main anode, which at the same time forms a sealing window, is formed by a late of an alloy of beryllium and a metal which emits X-ray, the relative content of this latter metal being less than that of beryllium.

16. X-ray tube as defined in claim 14, wherein the X-ray emitting metal is selected from the group comprising silver and copper.

17. X-ray tube as defined in claim 16, wherein the alloy of beryllium and silver has a silver content less than 8% and preferably 5%.

18. X-ray tube as defined in claim 2, of the type in which the envelope has a metallic portion which supports said main anode and said secondary anode forming said diaphragm, wherein at least that portion of the inside face of the said metallic envelope portion which is liable to receive direct or back-scattered electrons is covered with a layer of a metal identical to that forming the main anode.

* * * * *